United States Patent [19]

Ohara

[11] 3,977,462

[45] Aug. 31, 1976

[54] APPARATUS FOR PRODUCING A DIE CAST OF A COMPLICATED SHAPE

[76] Inventor: Isao Ohara, 27-21, Kidacho, Neyagawa, Osaka, Japan

[22] Filed: Dec. 16, 1974

[21] Appl. No.: 533,155

[30] Foreign Application Priority Data

May 20, 1974 Japan ..... 49-56254

[52] U.S. Cl. ..... 164/256

[51] Int. Cl.[2] ..... B22D 27/16

[58] Field of Search ..... 164/52, 252, 256, 258, 164/259, 335, 336, 155, 257, 254, 253

[56] References Cited

UNITED STATES PATENTS

| | | | |
|---|---|---|---|
| 2,125,080 | 7/1938 | Merrick | 164/252 X |
| 2,171,778 | 9/1939 | Yantis | 164/335 X |
| 2,829,408 | 4/1958 | Shuck | 164/258 |
| 2,966,709 | 1/1961 | Ruppel | 164/258 X |
| 3,005,232 | 10/1961 | Steinbock | 164/256 X |
| 3,199,158 | 8/1965 | Rigatti-Luchini | 164/258 |
| 3,280,434 | 10/1966 | Cecere | 164/258 |
| 3,519,061 | 7/1970 | Dunlop | 164/52 X |
| 3,666,919 | 5/1972 | Thiel | 164/336 UX |

*Primary Examiner*—Francis S. Husar
*Assistant Examiner*—John S. Brown
*Attorney, Agent, or Firm*—George B. Oujevolk

[57] ABSTRACT

A molding arrangement to produce a die cast of a complicated shape by using an air-evacuated, air-tight work chamber. The chamber has a crucible and a mold, and an inert gas is used. An arc is generated and the electric resistance of the inert gas is broken between a pair of electrodes provided in the chamber by oscillating a high frequency current from a high frequency oscillator circuit connected outside the chamber. The metal material is melted in the crucible by the arc, while supplying the inert gas and using discharging gas generated from the metal. When the metal is melted the injection of inert gas into the chamber is stopped, so as to make the chamber a vacuum. The furnace, which includes the chamber, is rotated and the melt in the crucible is transferred into the mold. The melt is then forced to reach every corner in the mold by the pressure of the inert gas which is injected again into the chamber.

5 Claims, 3 Drawing Figures

APPARATUS FOR PRODUCING A DIE CAST OF A COMPLICATED SHAPE

BACKGROUND OF THE INVENTION

This invention relates to a method of molding and an apparatus for producing a small casting or die cast of a complicated shape, used in a dental clinic field and in the industrial field and more particularly, the invention relates to a method and an apparatus for carrying out the melting of metal material in an inert gas atmosphere by feeding the gas into a chamber formed in a furnace for melting metal material and pouring the obtained molten material into a mold.

OBJECTS OF THE INVENTION

An object of the invention is to prevent the intermixing of oxidized substances and impurities in a melt, by treating the metal to be molded without contacting it with air, and thus to obtain a casting or die cast of good quality which is not impaired of good metal characteristics.

Another object of this invention is to provide a method and an apparatus for forcing the melt to reach every corner of the mold by the pressure of an inert gas for producing a casting of complicated form.

The invention, as well as other objects and advantages thereof will become more readily apparent from the following detailed description when taken together with the accompanying drawings, in which:

DETAILED DESCRIPTION OF THE INVENTION

Figure 1:
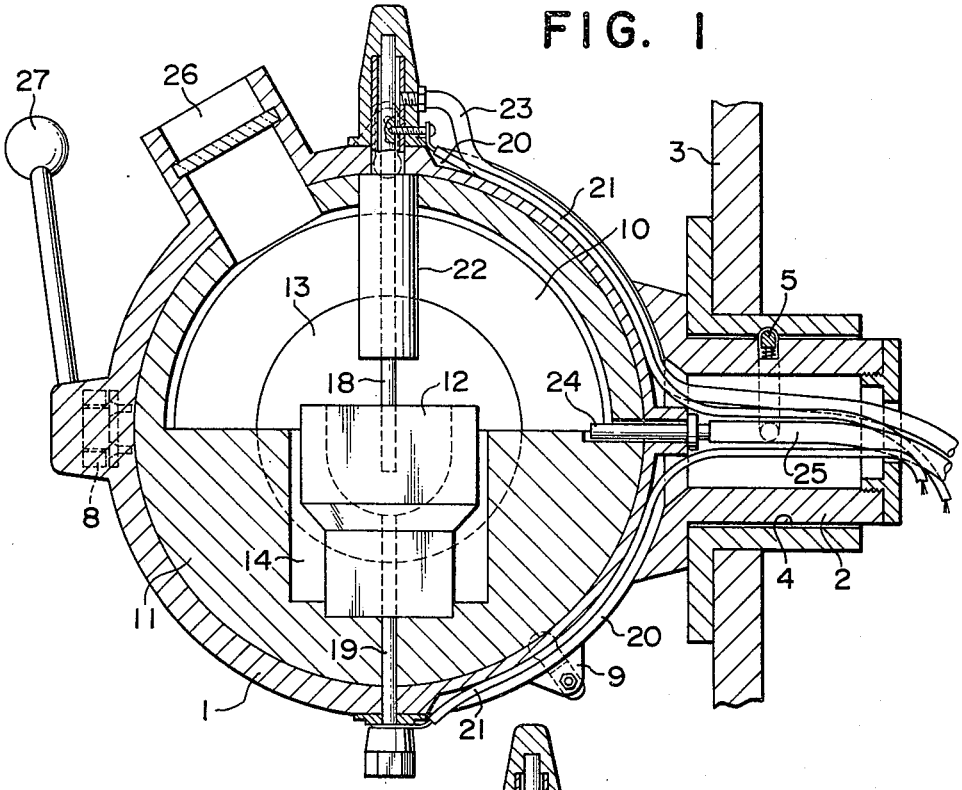
FIG. 1 is a front sectional view of a molding apparatus of the invention.
Figure 2:
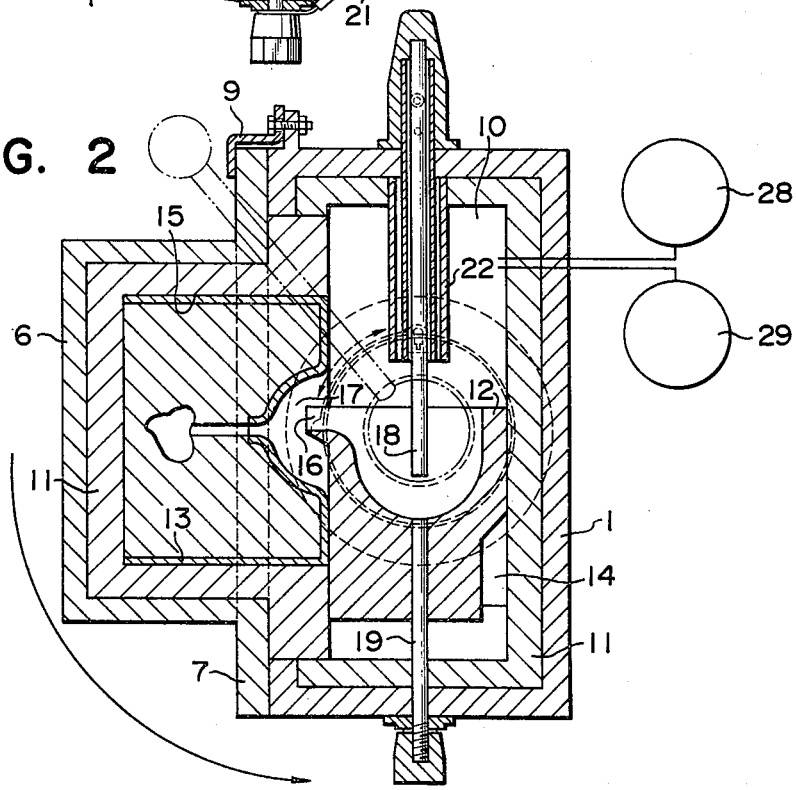
FIG. 2 is a side sectional view of the apparatus of FIG. 1.
Figure 3:
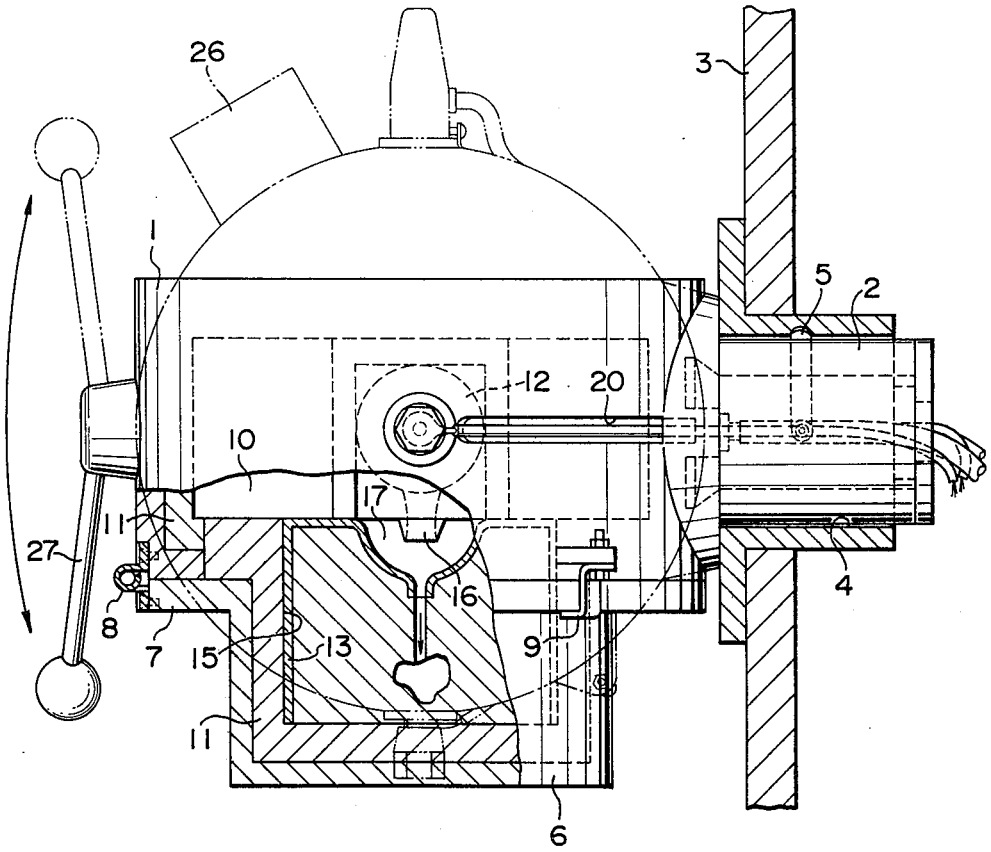
FIG. 3 is a front sectional of the apparatus, partially in section, showing the apparatus in a rotated position.

In the drawings, there is shown a furnace 1, a mounting base 3, a hatch 6, and air tight chamber 10, a crucible 12, a mold 13, electrodes 18 and 19, and inert gas nozzle 22 and an air outlet 24. Heat insulation 11 is used to line the furnace.

Therefore, according to the inventive concept, the apparatus has a furnace 1 rotatably pivoted to a mounting base 3. The furnace has a hatch 6 so mounted as to provide an opening of the furnace for closing an air tight chamber 10 provided in the furnace 1. Within the chamber 10 there is also a crucible 12, a mold 13 and a pair of upper and lower electrodes 18, 19 so disposed in the chamber 10 that one faces the top opening and the other the bottom of the crucible 12. Around the upper electrode 18 is an inert gas injection nozzle 22. An air outlet 24 is also provided from the chamber 10 through a projection 2, and, there is a high frequency oscillation circuit to produce a discharge arc between the electrodes. The furnace 1 can be rotated from the position where the crucible 12 is a normal condition for melting tc the position where the melt is poured from the crucible into the mold 13.

In FIG. 1, furnace 1 has a cylindrical shape, one end of which is opened, a projection 2 projects from its outer wall and the projection is rotatably mounted into an opening 4 of a fixing or mounting base 3 on which there is a stopper 5 disposed so as to set the projection 2 and the opening 4 in such a manner that the furnace 1, when rotated, stops rotation at a position separated by 90° from the position where the crucible 12 in the furnace is in the normal condition for melting.

A hatch 6 in a cylindrical form closes one end opening of the furnace 1 and has a flange 7, and is mounted to the furnace 1 by a hinge 8. The opening of the furnace can be closed air-tight or opened by the hatch, by manipulating a lock member for folding the flange 9. The interior of the hatch and the furnace 1, when tightly sealed, forms an air tight chamber 10.

In the air tight chamber 19, a heat insulating material 11 is provided along the entire inner wall surface of the furnace 1 and the hatch 6. The material is so placed as to form a recess 14 at the center portion in the furnace 1, for accepting a crucible 12, and a recess 15 at the center portion in the hatch 6 as a mold 13. The crucible 12 and the mold 13 are placed in the recesses 14 and 15, respectively, in such a manner that an outlet 16 of the crucible 12 communicates with an inlet 17 of the mold 13 when the furnace is turned by 90° to face with the mold.

Two electrodes 18 and 19 are arranged in face to face relationship in a vertical direction, one electrode 18 facing the top opening and the other 19 facing the bottom of the crucible 12 in chamber 10.

A nozzle 22 for inert gas, such as argon gas, covers the upper electrode 18, and connects at a position outside the furnace 1, with a gas pipe 23. The gas pipe 23 passes a guide 20, the projection 2, and an electromagnetic valve, not shown, and communicates with a gas bomb, not shown. An air outlet 24, which opens into the air tight chamber 10, communicates with a pipe 25 which connects to a suction pump, not shown, through the mounting base 3.

Furthermore, there is also a peep window 26, a handle 27 for turning the furnace 1, a vacuometer 28 and a pressure gauge 29.

The electrical circuit for controlling the apparatus of this invention, including a high frequency oscillator circuit for arc discharge between the electrodes 18 and 19 is provided in the mounting base 3.

In operation, a hatch 6 is closed after a metal material in a required amount is placed in the crucible 12, then air in the air-tight chamber 10 is removed through an air outlet 24 by the operation of a suction pump, not shown, so as to provide a vacuum in chamber 10 or 600 to 700 vacuum degrees.

When the desired vacuum state is obtained in the chamber 10, the suctioning of air from the outlet 24 is stopped, and inert gas such as argon gas, is injected from the injection inlet 22 for filling the chamber 10 with the gas. Then current is supplied to the electrodes 18 and 19, and the high frequency oscillator circuit is operated. An arc is formed due to the discharge between the two electrodes, and the heat produced thereby melts the metal material.

During the above process, the inert gas is continuously injected from the gas nozzle 22, while air and gases generated from metal, heat insulation 11, crucible 12, etc., are suctioned out through air outlet 24 by the operation of the suction pump.

When the metal is completely melted, the gas injection from the gas nozzle 22 is stopped and the furnace 1 holding the chamber 10 is turned or rotated by 90°. When the furnace is rotated into such a position that an outlet 16 of the crucible 12 communicates with an inlet 17 of the mold 13, the melt in the crucible 12 is poured from its outlet 16 to the inlet 17 of the mold 13. At this stage, the air is still suctioned out from the air outlet 24 to keep the chamber 10 in a vacuum.

After the melt is transferred completely into the mold 13, the air suctioning operation is stopped, and inert gas such as argon is introduced through the same outlet 24 in a pressure of 3 to 4 atm. into the chamber 10. And the melt is forced to reach every corner in the mold 13 by the pressure of the gas. When the melt in the mold 13 is cooled the die cast is taken away from the mold and thus the molding operation is finished.

As understood from the above explanation, the metal material does not contact air from the beginning of the melting to the end of the molding and, therefore, oxidized substances or impurities are not intermixed during melting and molding. Accordingly, a die cast of good quality, which is not impaired of good metal characteristics, obtained.

Further, since the melt is forced to enter into the mold by the pressure of the inert gas injected through a nozzle 22, the melt reaches every corner in the mold and therefore, a die cast of a complicated shape can be obtained.

The arc generation between a pair of electrodes is caused by a conduction of a high frequency current, and the manipulation of the current is not difficult and requires no technical skill and therefore, the arc can be generated with ease.

Further, since the air tight chamber is filled, during the discharge between the electrodes with an inert gas, the electrodes are not oxidized, and therefore the service life of the electrodes is lengthened.

The handling of the apparatus is easy and the construction can be made simple since the furnace is so constructed as to be rotated so that the melt is transferred from the crucible to the mold when the furnace is rotated to a predetermined position.

I claim:

1. A molding apparatus comprising in combination:

a. a base having rotation means for rotation about a horizontal axis;

b. a furnace with first and second cavities having a projection member (2) held by said rotation means for rotation having a hatch (6) for filling material into said furnace and closing the furnace air-tight;

c. a crucible defined in one of said cavities and a mold in the other of said cavities so disposed that liquid in said crucible can be flowed into said mold by partially rotating said furnace;

d. first and second electrodes extending across said chamber opposite each other and circuit means to discharge across the electrodes;

e. an inert gas injection nozzle disposed around one of said electrodes and an air outlet (24) for coupling to a vacuum pump; and f. means connected to said furnace to rotate the furnace.

2. An apparatus as claimed in claim 1 wherein said furnace is generally spherically shaped.

3. An apparatus as claimed in claim 2 wherein said electrodes extend to almost a diameter across said spherical shape.

4. An apparatus as claimed in claim 3 said crucible having an outlet (16) and said mold having an inlet (17), the outlet (16) being in communication with the inlet (17).

5. An apparatus as claimed in claim 4 wherein said air outlet (24) passes through said projecting member (2).

* * * * *